US005570569A

United States Patent [19]

Masuda

[11] Patent Number: 5,570,569

[45] Date of Patent: Nov. 5, 1996

[54] QUADRANGULAR PACKAGE BAG AND METHOD AND APPARATUS THEREFOR

[76] Inventor: Tokihisa Masuda, 1730-11 Ooaza Sakata, Okegawa-shi, Saitama-ken, Japan

[21] Appl. No.: 366,769

[22] Filed: Dec. 30, 1994

[30] Foreign Application Priority Data

Apr. 8, 1994 [JP] Japan ..... 6-093853

[51] Int. Cl.[6] ..... B65B 7/18; B65B 9/20

[52] U.S. Cl. ..... 53/410; 53/451; 53/482; 53/133.2; 53/552; 53/372.2

[58] Field of Search ..... 53/451, 479, 481, 53/482, 551, 552, 554, 133.2, 370.4, 371.7, 563, 410, 372.2

[56] References Cited

U.S. PATENT DOCUMENTS

| | | | |
|---|---|---|---|
| Re. 21,065 | 5/1939 | Copeman . | |
| Re. 27,302 | 2/1972 | Schneider et al. | 53/551 X |
| 732,889 | 7/1903 | Paver . | |
| 1,446,563 | 2/1923 | Hughes . | |
| 1,525,015 | 2/1925 | Weeks . | |
| 1,863,216 | 6/1932 | Wordingham . | |
| 1,978,631 | 10/1934 | Herrlinger . | |
| 2,048,123 | 7/1936 | Howard . | |
| 2,170,147 | 8/1939 | Lane . | |
| 2,177,919 | 10/1939 | Vogt | 53/133.2 X |
| 2,278,673 | 4/1942 | Savada et al. . | |
| 2,302,259 | 11/1942 | Rothfuss . | |
| 2,355,559 | 8/1944 | Renner . | |
| 2,371,985 | 3/1945 | Freiberg . | |
| 2,411,328 | 11/1946 | MacNab . | |
| 2,510,120 | 6/1950 | Leander . | |
| 2,621,142 | 12/1952 | Wetherell . | |
| 2,822,287 | 2/1958 | Avery . | |
| 2,846,060 | 11/1958 | Trillich . | |
| 2,850,842 | 9/1958 | Eubank . | |
| 2,883,262 | 4/1959 | Borin . | |
| 3,022,605 | 2/1962 | Reynolds . | |
| 3,121,647 | 2/1964 | Harris . | |
| 3,130,113 | 4/1964 | Silman . | |
| 3,271,922 | 9/1966 | Wallerstein et al. . | |
| 3,508,372 | 4/1970 | Wallerstein et al. . | |
| 3,620,366 | 11/1971 | Parkinson . | |
| 3,681,105 | 8/1972 | Milutin et al. . | |
| 3,793,799 | 2/1974 | Howe et al. . | |
| 3,857,223 | 12/1974 | Dominici | 53/552 X |
| 3,996,724 | 12/1976 | Smith | 53/371.7 X |

(List continued on next page.)

FOREIGN PATENT DOCUMENTS

| | | |
|---|---|---|
| 2610604 | 8/1988 | France . |
| 345464 | 2/1917 | Germany . |
| 47448 | 11/1960 | Japan . |
| 242708 | 10/1990 | Japan . |

OTHER PUBLICATIONS

Speed Cover® Brochure, 1989, Highland Supply Corp.
Speed Sheets™ and Speed Rolls, 1990 Highland Supply Corp.

*Primary Examiner*—Horace M. Culver
*Attorney, Agent, or Firm*—Browdy and Neimark

[57] ABSTRACT

It is an object of the present invention to manufacture efficiently packing bags which are packed in cases of corrugated fiberboard or the like at a good filling rate without dead space. A film sheet 14 from a bobbin 13 is formed to a quadrangular barrel body 24' along the outside of a cylinder 21 through a former 20, a top plane 10 is squeezed and sealed in a onesidedly slant manner, and then the quadrangular packing bag thus manufactured is transferred, through a guide chute 55, on a belt conveyor 54 in the regular posture (a) or inverse posture (b) to a case of corrugated fiberboard or the like. Conventional packing bag manufacturing mechanisms can be used, packing bags can be mass-produced fully automatically in a uniform manner at a high accuracy, and packing bags thus manufactured can be packed in cases of corrugated fiberboard or the like without dead space, thus reducing costs of transport securely.

14 Claims, 12 Drawing Sheets

U.S. PATENT DOCUMENTS

| | | | |
|---|---|---|---|
| 4,004,398 | 1/1977 | Larsson et al. | 53/551 X |
| 4,054,697 | 10/1977 | Reed et al. . | |
| 4,117,649 | 10/1978 | Egli | 53/552 X |
| 4,118,890 | 10/1978 | Shore . | |
| 4,129,976 | 12/1978 | Grundler et al. | 53/552 |
| 4,216,620 | 8/1980 | Weder et al. . | |
| 4,280,314 | 7/1981 | Stuck . | |
| 4,297,811 | 11/1981 | Weder . | |
| 4,300,312 | 11/1981 | Weder . | |
| 4,333,267 | 6/1982 | Witte . | |
| 4,380,564 | 4/1983 | Cancio et al. . | |
| 4,387,547 | 6/1983 | Reil | 53/551 X |
| 4,413,725 | 11/1983 | Bruno et al. . | |
| 4,442,656 | 4/1984 | Wylie, Sr. | 53/552 |
| 4,517,790 | 5/1985 | Kreager | 53/552 |
| 4,546,875 | 10/1985 | Zweber . | |
| 4,562,691 | 1/1986 | Rapparini | 53/552 |
| 4,640,079 | 2/1987 | Stuck . | |
| 4,733,521 | 3/1988 | Weder et al. . | |
| 4,765,464 | 8/1988 | Ristvedt . | |
| 4,773,182 | 9/1988 | Weder et al. . | |
| 4,835,834 | 6/1989 | Weder . | |
| 4,901,423 | 2/1990 | Weder . | |
| 5,007,229 | 4/1991 | Weder et al. . | |
| 5,038,933 | 8/1991 | Weder . | |
| 5,111,613 | 5/1992 | Weder et al. . | |
| 5,127,817 | 7/1992 | Weder et al. . | |
| 5,129,182 | 7/1992 | Weder . | |
| 5,152,100 | 10/1992 | Weder et al. . | |
| 5,152,101 | 10/1992 | Weder et al. . | |
| 5,161,348 | 11/1992 | Weder . | |
| 5,181,339 | 1/1993 | Weder et al. . | |
| 5,184,390 | 2/1993 | Weder . | |
| 5,199,242 | 4/1993 | Weder et al. . | |
| 5,208,027 | 5/1993 | Weder et al. . | |
| 5,221,248 | 6/1993 | Weder et al. . | |
| 5,228,236 | 7/1993 | Weder et al. . | |
| 5,228,934 | 7/1993 | Weder et al. . | |
| 5,245,814 | 9/1993 | Weder . | |
| 5,254,072 | 10/1993 | Weder et al. . | |
| 5,259,106 | 11/1993 | Weder et al. . | |
| 5,274,900 | 1/1994 | Weder . | |
| 5,286,246 | 2/1994 | Weder et al. . | |
| 5,286,247 | 2/1994 | Weder et al. . | |
| 5,291,721 | 3/1994 | Weder et al. . | |
| 5,307,606 | 5/1994 | Weder . | |
| 5,314,398 | 5/1994 | Weder et al. . | |
| 5,332,610 | 7/1994 | Weder et al. . | |
| 5,335,475 | 8/1994 | Weder et al. . | |
| 5,335,476 | 8/1994 | Weder . | |
| 5,369,934 | 12/1994 | Weder . | |
| 5,381,642 | 1/1995 | Weder et al. . | |

QUADRANGULAR PACKAGE BAG AND METHOD AND APPARATUS THEREFOR

BACKGROUND OF THE INVENTION

1. Field of the Invention

The disclosed technique belongs to the technical field of manufacturing quadrangular packing bags which are in quadrangular barrel shape having a quadrangular cross section, a bottom plane being flat and a top plane being onesidedly slant with its lapped edge portion being squeezed and sealed by means of heat seal, adhesive or the like and which are filled with block and powder merchandise such as light and bulky snack confectionery or the like and seasonings or the like or liquid and viscous merchandise such as juice and others by a predetermined weight or volume and contained in cases of corrugated fiberboard or the like at an excellent filling rate.

2. Description of the Prior Art

As well known, with improving civil life and consequent prospering business activities, various kinds of merchandise are traded in small and large quantities: hence, it is considered important to attain effective transport in distribution stages and effective display at shops as well as effective weighing and sorting processes in a distribution market.

Accordingly, in the weighing process, accurate, effective processing methods using high-tech such as so-called combined weighing technique have taken root; in the sorting process, a computer controlled high-precision processing technique is put in actual use utilizing bar code and pattern recognition means and other advanced means; and as for display at shops, various preferable forms from the viewpoint of sellers and purchasers are introduced utilizing special designs and interior techniques.

However, in transport such as collection and delivery at distribution stages including land transport, a cost-related important bottleneck to the distribution economy is hardly remedied, and forms of transport have been as they were.

Meanwhile, according to a popular form for trading merchandise in the distribution market, general consumer goods, particularly foods and the like are contained in sealed containers such as packing bags at a predetermined weight, such packing bags being of film sheets (including laminated sheets) of predetermined synthetic resins having no adverse effect on the quality of merchandise in many cases and being mass-produced stably at low costs for use at supermarkets and the like; usually, a so-called pillow type packing bag 1 as shown in FIG. 24 is used for business transactions, lateral heat seals 3, 3 being applied to a material film sheet 2 at both end portions thereof and also a longitudinal heat seal 4 being applied thereto for attaining a sealed state and thereby maintaining a sanitary condition and preventing deterioration in quality, an appropriate copy and instructions being printed on the bag; in some case, a quadrangular barrel type, i.e. so-called gusset type packing bag 1' in a steep rafter roof-like shape having a squeezed lateral heat seal 3' on a top plane and a longitudinal heat seal 4' is used, a bottom plane 5' being flat, the generally rectangular shape providing the merits of better stability and appearance when displayed at shops as compared with the aforesaid pillow type packing bag 1 and a relatively large containing capacity, thereby providing higher practical applicability.

Such forms are disclosed, for example, in Japanese Patten Application Laid-Open Publication Nos. 47-50155, 53-12880 and 58-15305.

Such packing bags (containers) used for selling include Tetra Pack and Pure Pack used widely for containing milk, juice and liquor and those having a spout on the top plane thereof for convenience in use.

Needless to say, various other three-dimensional packing bags (containers) including a box type are used in the distribution market.

However, the aforementioned conventional forms have the following problems which prevent the aforesaid transport cost related economic bottleneck from being remedied.

In other words, although the stable mass production associated with bag making/packing and cheap trading forms have taken root for the pillow type packing bag 1 in FIG. 24, packing in a predetermined case 8 of corrugated fiberboard or the like for transport of collection/delivery involves dead spaces 9, 9 . . . in the case 8 formed unavoidably due to relative arrangement of end portions of packing bags 1 stemming from the pillow type, and accordingly the filling rate reduces by the dead spaces 9, 9 . . . with a consequent reduction of at least 20% or more in some case in filling efficiency; needless to say, transport costs increase meaninglessly by the dead spaces 9, and hence the manufacturing side uses various devices for reducing the dead spaces 9 as much as possible in packing in the case 8, such as arranging bags like sashimi slices or overlapping top end portions when arranged in the lay-on-the-side posture; however, such devices are far away from a substantial solution because the problem derives from the form of packing; if it is forcibly attempted to increase the filling rate, the compaction will cause a demerit such as a damage to merchandise contained in the packing bags 1.

As for the gusset type packing bag 1' shown in FIG. 25, when packed in the upright posture or lay-on-the-side posture in the case 8, dead spaces 9', 9' . . . are also unavoidably formed due to a squeezed, sealed portion on the steep rafter roof-like formation as shown in FIG. 27, thus reducing the merit of relative surface-to-surface abutting arrangement of quadrangular packing bags 1', 1' . . . and accordingly putting a brake on a reduction in transport costs as in the case of the aforementioned form.

When packing the gusset type packing bags 1' in the case 8, there has arisen an obstacle to smooth packing due to the mutual interference and resultant deformation of lapped edge portions at squeezed, sealed portions.

Such a problem is also observed with Tetra Pack and Pure Pack.

SUMMARY OF THE INVENTION

In view of the problems in packing a predetermined number of conventional packing bags filled with merchandise in cases of corrugated fiberboard or the like for transport, the inventor has devised a quadrangular packing bag 1''' shown in FIG. 28 in order to reduce distribution costs by making the filling rate as close to 100% as possible when packing in a distribution container of corrugated fiberboard or the like while making use of various merits of quadrangular packing bags and has applied for a utility model registration by Japanese Utility Model Registration Application No. 5-58187, thus having made an innovative proposal to the business circle of distribution.

The packing bag 1''' is formed in generally flat panels (planes), and is such that a barrel portion (general portion) has a quadrangular cross-section, a bottom plane 5' is flat, a flat front portion 11 extends upward while a rear portion 12 has a longitudinal seal 4' and extends upward, a top plane 10 is onesidedly slant at a freely set angle, for example, at 45' in consideration of a more voluminous appearance for the same contents for .giving favorable impressions to the consumers' mentality and of efficiency in filling bags with merchandise and in operations of every part of a packing apparatus, and the slant top plane combines with the rear portion 11 with a lapped edge portion 13 being squeezed and sealed; hence, from its structural merit, a pair of packing bags 1''', 1''' with their top planes 10, 10 facing each other forms a rectangular parallelepiped by mutual complement: accordingly, when the packing bags 1''', 1''' . . . in FIG. 28 are packed in the lay-on-the-side posture (or in the upright posture) in an adjoining manner in the case 8 of corrugated fiberboard or the like the aforesaid dead spaces 9, 9' become nearly zero: also, the lapped edge portions 13, 13 do not interfere with packing because of their flat shape, and the proposed bag shape not only causes no hindrance to the removal of the packing bag 1''' itself from the case and to display at shops but allows design related merits to be utilized, and hence a great contribution to reduction in transport costs of merchandise contained in packing bags in the distribution market is expected.

The packing bag 1''' is not necessarily made of a film-like sheet (including laminated sheets), but may be, for example, a container formed out of plastic having a required strength and rigidity and a shape maintaining property, the packing bag 1''' in the form of such a plastic container being able to exhibit its latent merits.

Needless to say, when bags are to contain foods or the like, materials having no sanitarily adverse effect on contained merchandise will be selected as materials for bags.

However, the novel packing bag 1''', which contains various kinds of merchandise including foods as described above and is in such a shape that allows packing in a case of corrugated fiberboard or the like at a high filling efficiency with a resultant advantage to reduction in transport costs, assumes the structure having the flat bottom plane 5', the onesidedly slant top plane 10 and the lapped edge portion 13 parallel to the front plane 12 as shown in FIG. 28, and consequently a manufacturing technique for stably mass-producing the packing bags 1''' at low costs over a long period of time has not been developed yet with a resultant failure to meet the aforementioned large latent demand; in this connection, it is difficult for a tentative form (feasible if desired) utilizing the apparatus of manufacturing the gusset type packing bags 1' in FIG. 25 to securely manufacture the packing bags 1''' as designed; accordingly, the distribution market is in a great need of a secure manufacturing technique for the packing bags 1''' in view of a future increase in the demand.

In this connection, the inventor and applicant have obtained reliable background data by their distribution market research.

It is theoretically, scientifically and technologically possible for the inventor to devise and realize a new technique completely different from a conventional technique for manufacturing the packing bags 1''' (the inventor has proposed various tentative plans, though), the new technique leading to a great improvement in the distribution market; however, in view of the fact that a newly required investment of a considerable amount and associated maintenance costs are not welcomed for the reason of the economical effect such as the aforesaid transport costs, an improvement of the degree of contribution to the distribution market by utilizing, as much as possible, the commonly used, stably operated technique for manufacturing conventional packing bags is also what the inventor and applicant strongly wish.

It is an object of the applied invention to provide an excellent method of manufacturing quadrangular packing bags and an apparatus using directly the method, the method dealing with various technological bottlenecks associated with the manufacture of packing bags having a novel onesidedly slant top plane and a squeezed, sealed portion, which packing bags are quite effective in the distribution market which stands on the aforesaid conventional technique and requires the stable supply thereof, the method utilizing the existing technique of manufacturing packing bags as a base as much as possible, the method being intended to securely and stably mass-produce the packing bags at low costs, thereby meeting a strong demand for the packing bags and contributing to the packing technique utilizing field in the distribution industry.

DETAILED DESCRIPTION OF THE PREFERRED EMBODIMENT

An embodiment of the applied invention will now be described with reference to FIGS. 1–23.

Figure 24:
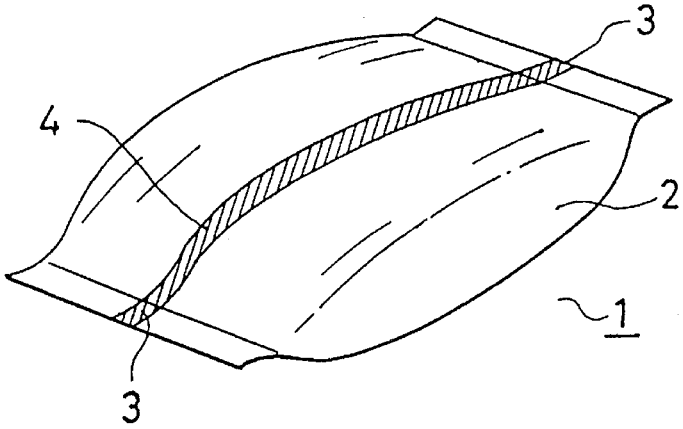
FIG. 24 is a perspective view illustrating a form of a packing bag based on the prior art.

The same features as in FIG. 24 and subsequent figures are denoted by common reference numerals.

Figure 25:
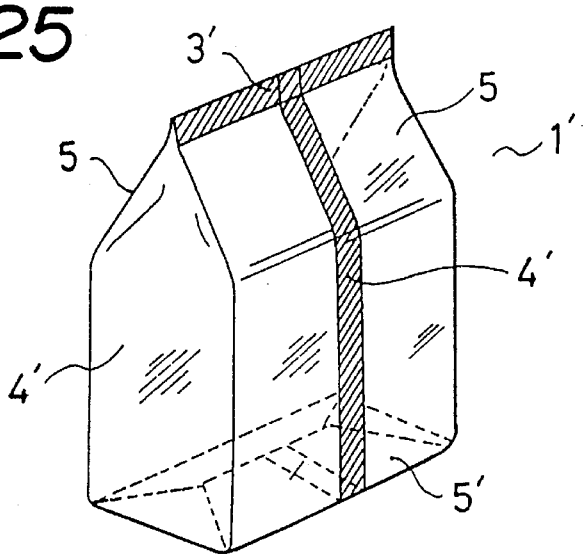
FIG. 25 is a perspective view illustrating another form of the same.
Figure 26:
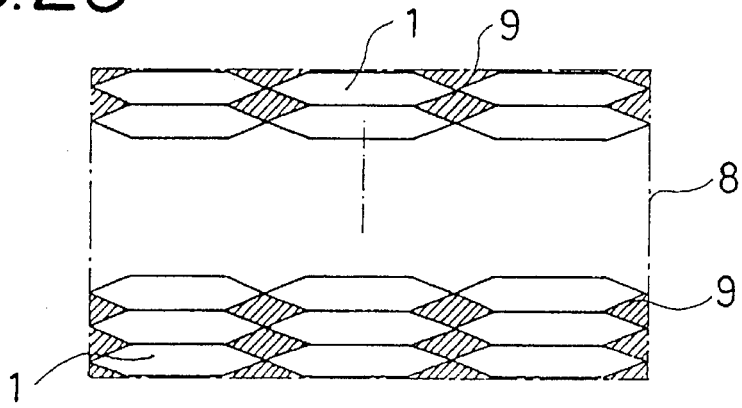
FIG. 26 is a schematic cross-sectional view illustrating the cased form of packing bags of FIG. 24.
Figure 27:
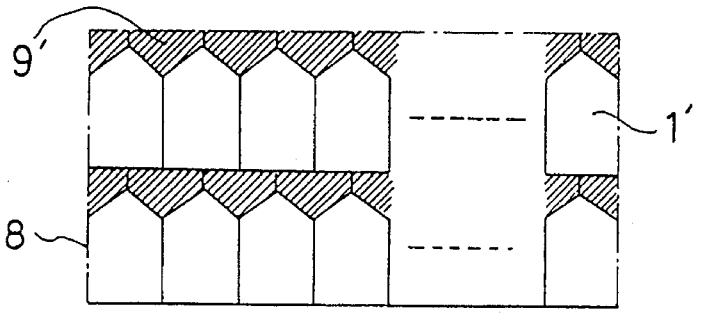
FIG. 27 is a schematic cross-sectional view illustrating the cased form of packing bags of FIG. 25.
Figure 28:
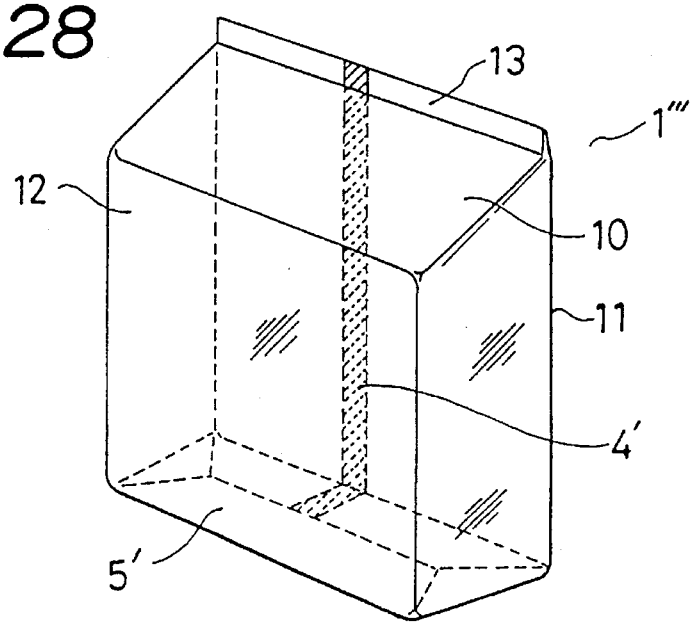
FIG. 28 is a schematic perspective view illustrating a novel packing bag.
Figure 29:
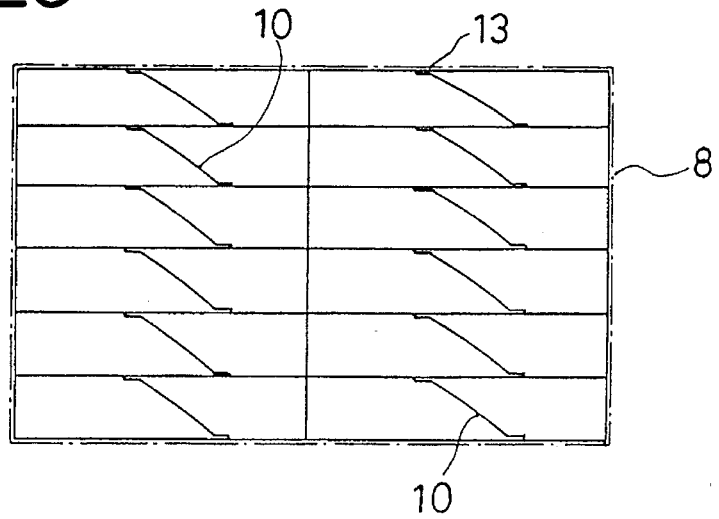
FIG. 29 is a schematic cross-sectional view illustrating the cased form of packing bags according to the applied invention.

The illustrated embodiment is a form of manufacturing continuously the packing bag 1''' having a flat bottom plane and a onesidedly slant top plane shown in FIG. 28 from a predetermined synthetic resin film sheet, and the embodiment partially utilizes the technique of an apparatus for manufacturing the gusset type packing bag 1' shown in FIG. 25.

Figure 1:
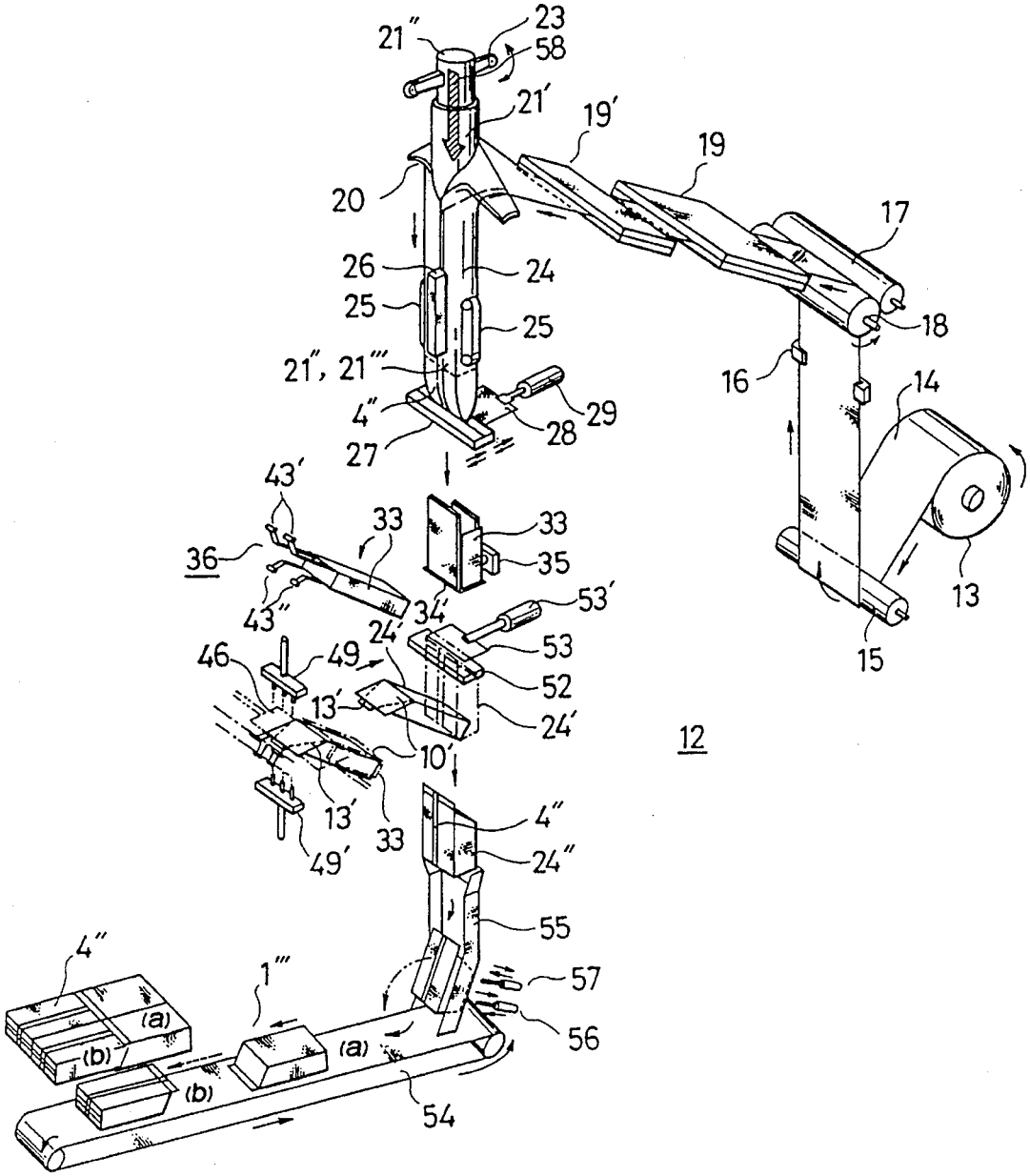
FIG. 1 is a schematic perspective view illustrating an overall process of a first embodiment of the applied invention.
Figure 2:
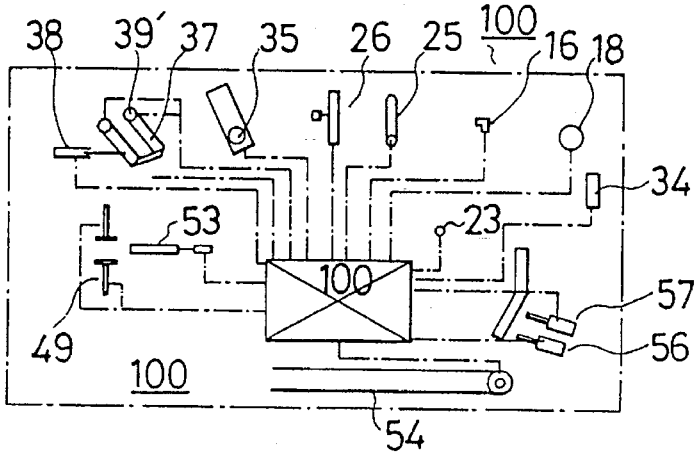
FIG. 2 is a control mechanism diagram of the same.
Figure 3:
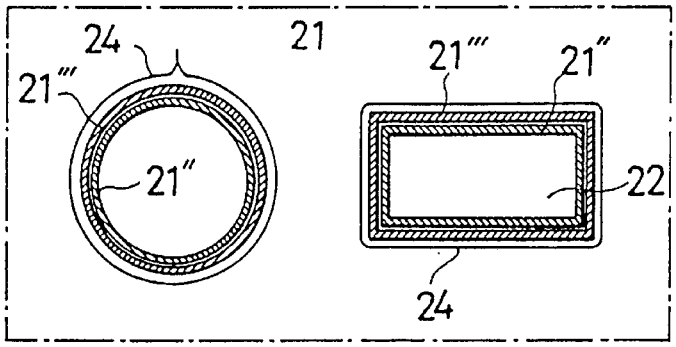
FIG. 3 is a cross-sectional view illustrating a cylinder of a second portion of a former.

In the embodiment shown in FIGS. 1–19, reference numeral 2 denotes an apparatus for manufacturing the merchandise packing bag 1''', which manufacturing apparatus is the core of one subject matter of the applied invention; a bobbin 13 is mounted to an apparatus frame (not shown), and a predetermined film-like sheet 14 made of a synthetic resin or the like coming from the bobbin 13 passes a dancer roll 15 and is pressed against a presser roll 17 and fed by a fixed dimension by a feed roll 18; the sheet 14, on the way to the feed roll 18, passes a device 16 which detects various register marks previously printed thereon, and at a latter stage passes stampers 19, 19' which stamp longitudinal and lateral ruled lines for making inward and outward fold marks; as in the conventional form, the sheet 14 from the stampers 19, 19' is fed to a former 20, formed to a cylindrical shape by the former 20, and then formed to a quadrangular barrel 24' by a dual cylinder 21 shown in FIG. 3 which is integrated with the former 20 and extends downward; in said process, as shown in FIG. 3, the cylinder 21 comprises a circular cylinder 21" extending from the upper portion thereof to the mid portion and inner and outer quadrangular cylinders 21", 21''', respectively, extending from the mid portion to the lower portion, the inner and outer quadrangular cylinders 21", 21''' having a rectangular cross-section and being slidable relatively to each other, the outer quadrangular cylinder 21''' being connected with the inner quadrangular cylinder 21" in a vertically slidable manner by means of a link 23 through a lift drive (not shown in FIG. 1).

The form shown in FIG. 1 primarily represents a process flow.

Belt type film feeders 25, 25 for feeding the sheet 14 by a fixed dimension are disposed outside the cylinder 21 in an abutting manner, and a longitudinal heat sealer 26 heat seals a longitudinally lapped edge portion of the sheet 14.

Figure 4:
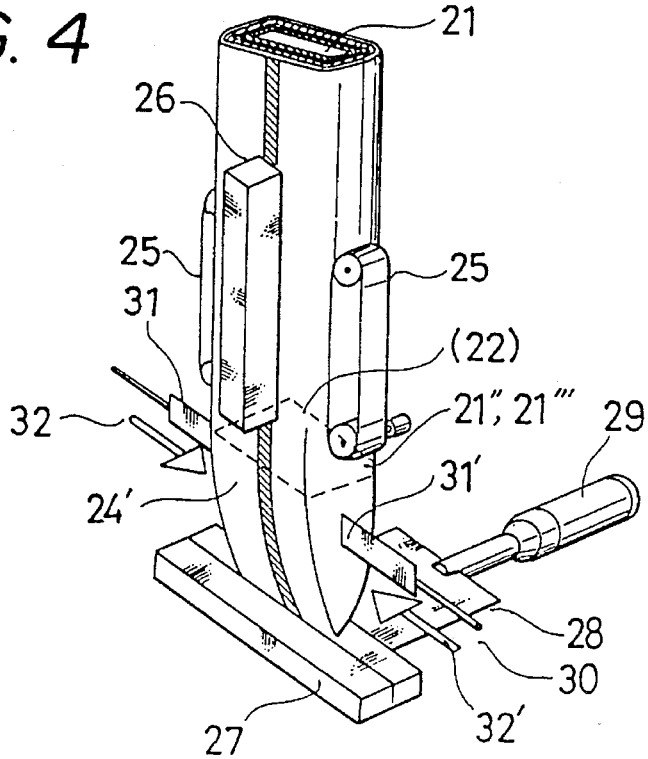
FIG. 4 is a schematic perspective view of a cornering mechanism portion for the lower portion of a quadrangular barrel.
Figure 5:
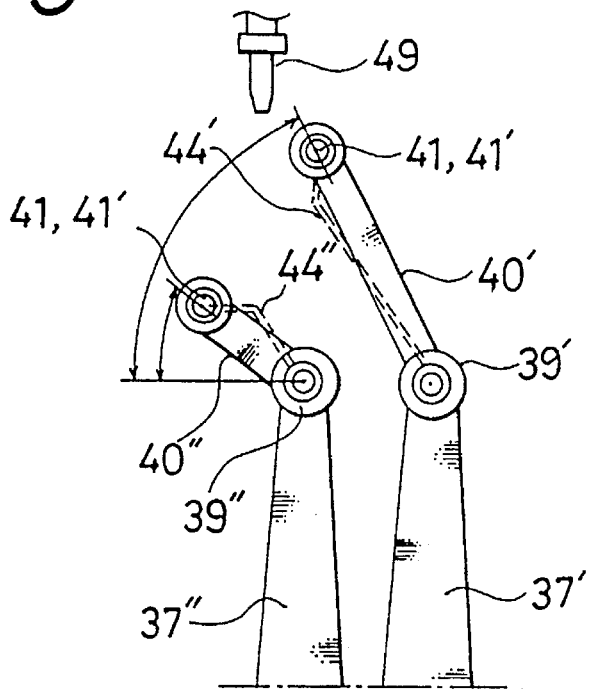
FIG. 5 is a schematic side view illustrating the relative arrangement between a squeezing-sealing device and a catcher.

As shown in FIG. 4, a lateral heat sealer 27 equipped with a cutter (not shown) is located under the longitudinal heat sealer 26 at the lower portion of the quadrangular cylinders 21", 21''', and an air cylinder 29 having a bottom receiver plate 28 which slides under the lateral heat sealer 27 is provided; moreover, a cornering device 30 for cornering a flat bottom 5' of the packing bag 1''' is provided together with the devices, folding bars 31, 31' and gusset tuckers 32, 32' being disposed opposed to each other in a retractable manner, respectively.

The relational arrangement of mechanisms in this portion described above is not shown in FIG. 1, but is schematically shown in FIG. 4.

Figure 12:
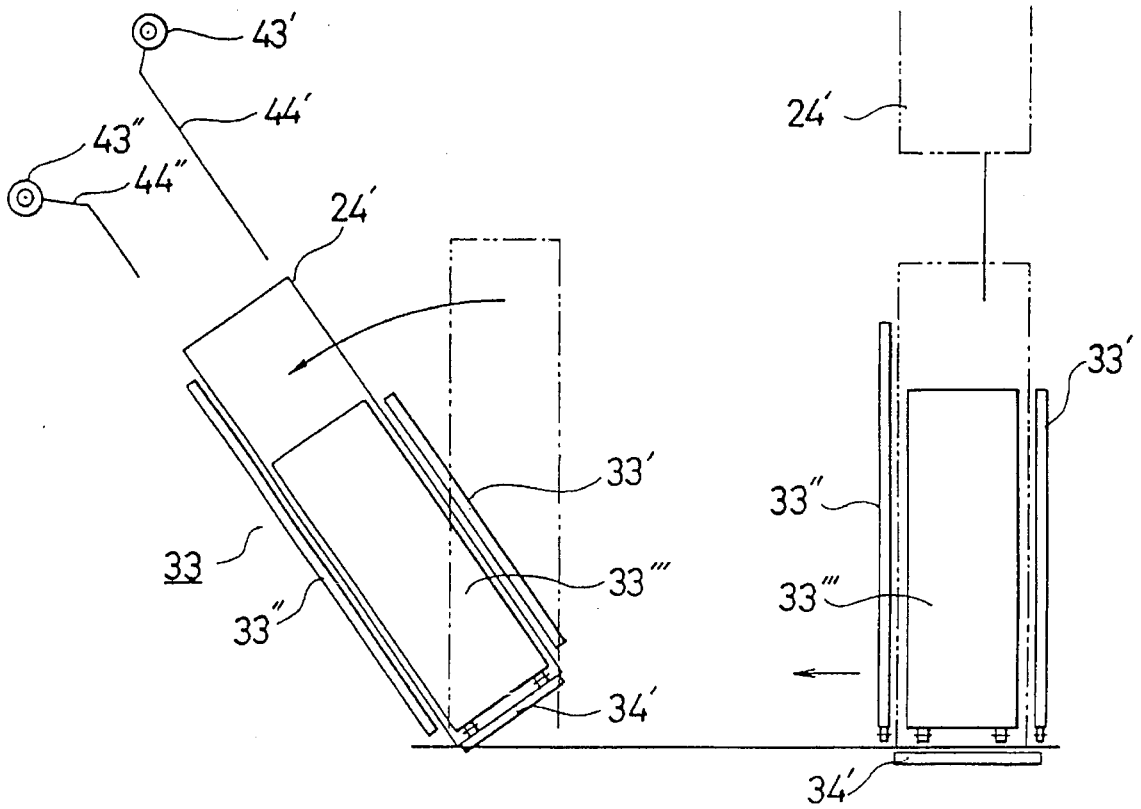
FIG. 12 is a schematic side view illustrating the relative arrangement between a catcher and the squeezing-sealing device.
Figure 13:
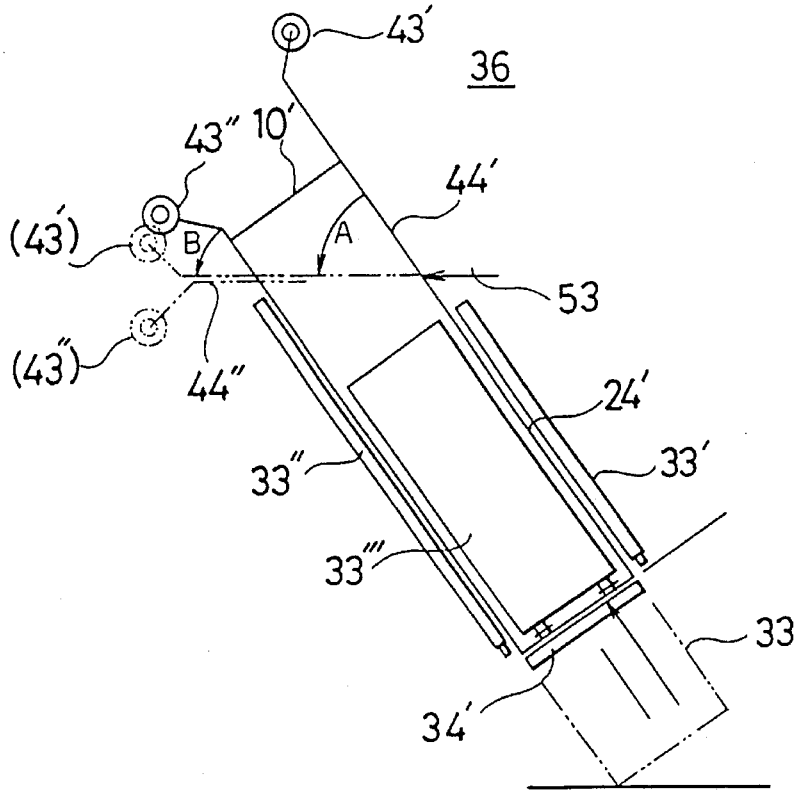
FIG. 13 is a schematic cross-sectional side view illustrating the insertion of forming plates into the quadrangular barrel.

A catcher 33 is located under the cornering device 30 for holding temporarily the quadrangular barrel body 24' which will undergo a forming process at subsequent stages, which catcher is formed in four divisions that have a predetermined width and height and correspond to four peripheral planes of the quadrangular barrel body 24'; as shown in FIGS. 12 and 13, front and rear panels 33', 33" and both side panels 33''' are able to be opened/closed at their lower supporting points for easy transfer of the quadrangular barrel body 24', and a bottom receiver plate 34' is designed to open downward.

The bottom receiver plate 34' can be held in proximity or released to move away by means of an air cylinder (not shown) or the like, and is also provided with an electromagnetic device 35 in order to tilt or right the catcher 33.

As for the initial position with respect to the catcher 33, the electromagnetic device 35 for tilting/righting the catcher 33 is sited below the cylinder 21; the catcher 33 is in the stand-by state with its upper portion being widened outward in order to receive easily and securely the quadrangular barrel body 24' the bottom portion of which is formed to the flat bottom 5' and which is filled with a predetermined amount of a merchandise 58; when the quadrangular barrel body 24' filled with the merchandise 58 drops and is caught in the catcher 33, the catcher 33 moves forward (left side on the figure) and is put in the tilted posture at a predetermined angle (tilted leftward on the figure).

Figure 6:
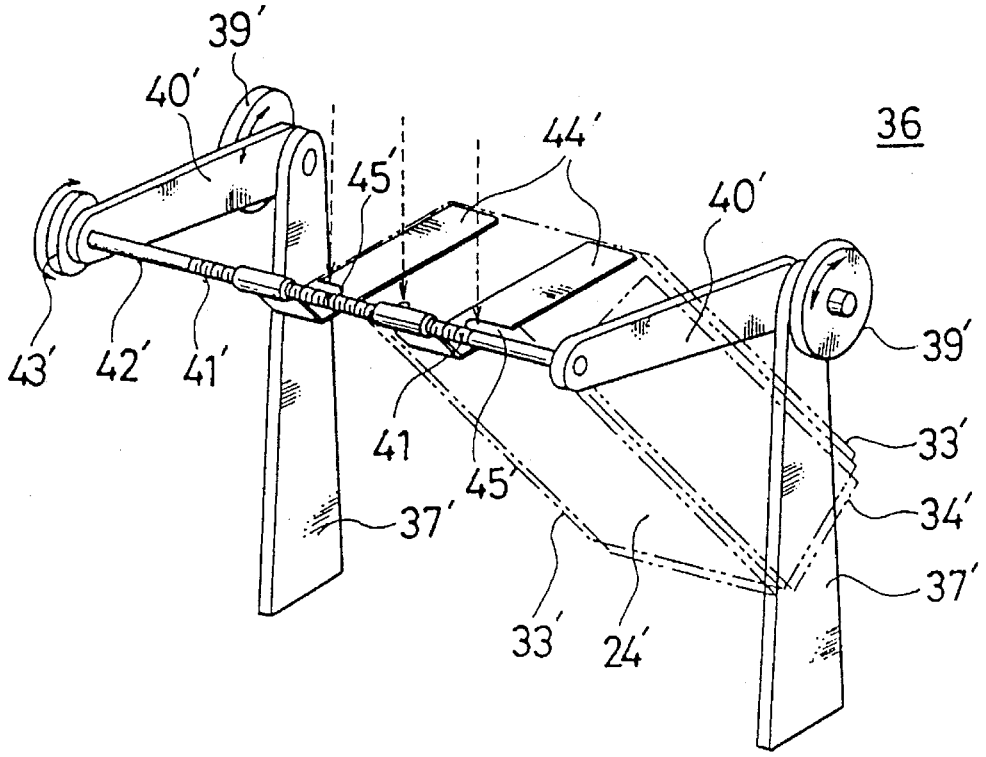
FIG. 6 is a schematic perspective view illustrating the front forming plate portion of the squeezing-sealing device.
Figure 7:
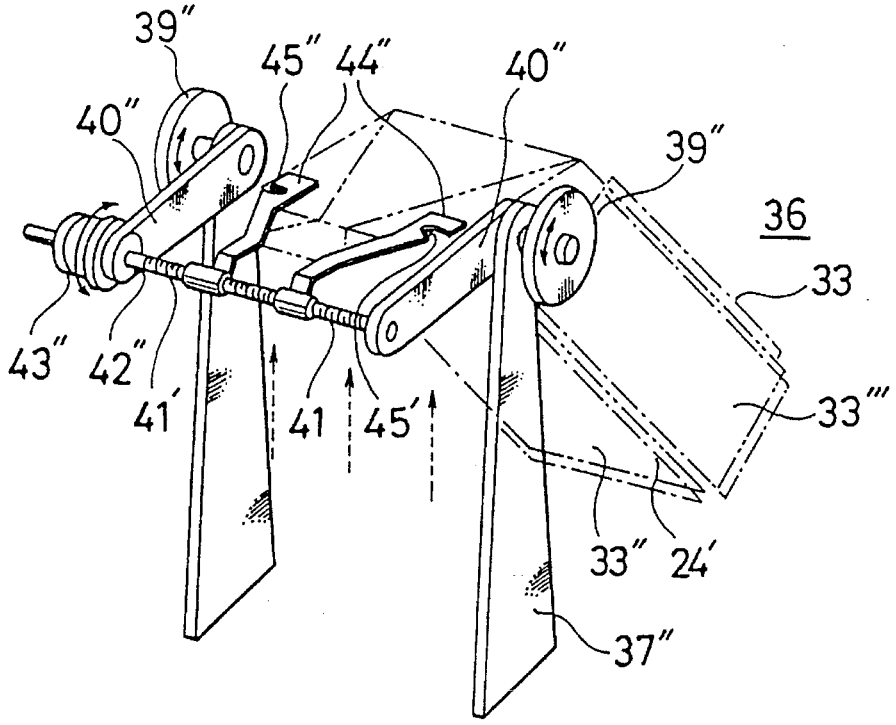
FIG. 7 is a schematic perspective view illustrating the rear forming plate portion of the squeezing-sealing device.
Figure 8:
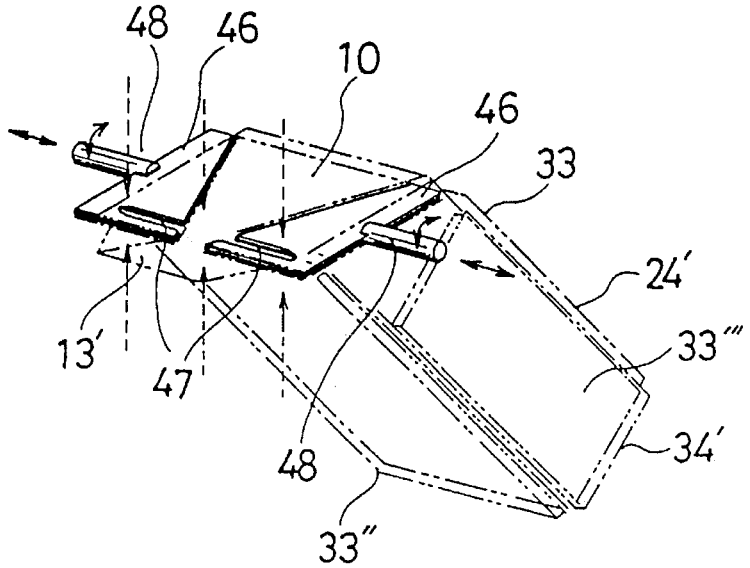
FIG. 8 is a schematic perspective view illustrating the push-in device of the same.
Figure 9:
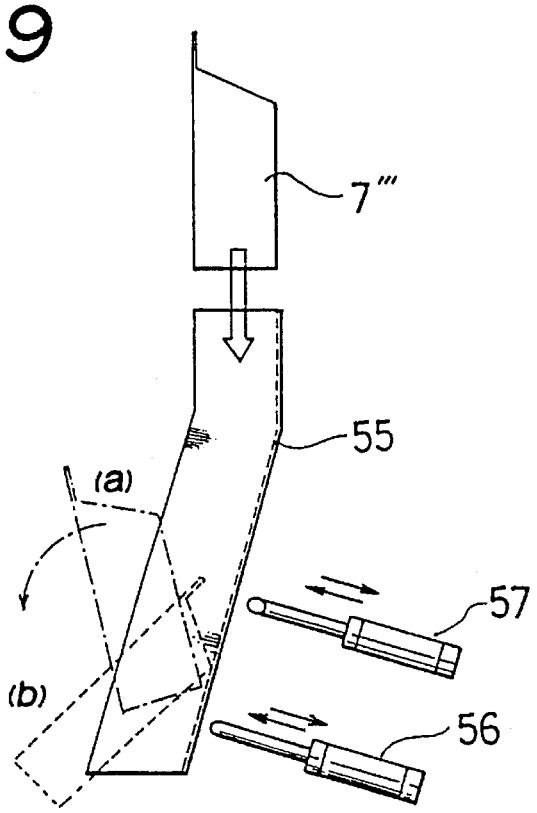
FIG. 9 is a side view illustrating the relative arrangement between an inverting device and a guide chute.
Figure 10:
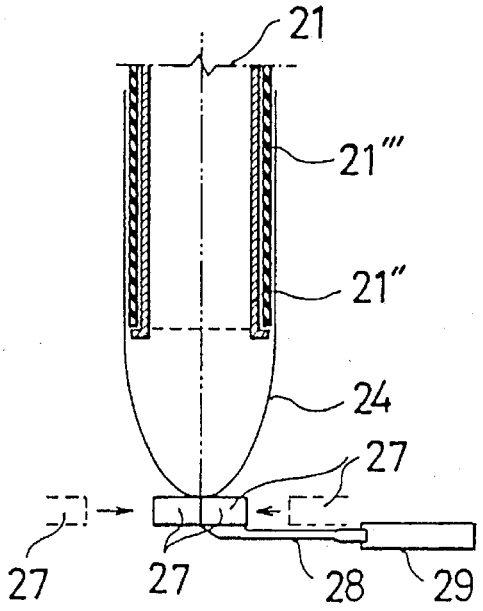
FIG. 10 is a schematic side view illustrating the relative arrangement between the lower portion of a cylinder and a heat sealer.
Figure 11:
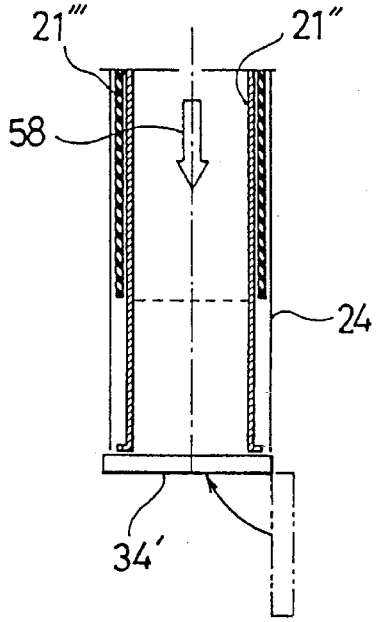
FIG. 11 is a schematic side view illustrating the relative arrangement between the bottom portion of the cylinder and a bottom receiver plate.

A squeezing-sealing device 36 for squeezing/sealing the top plane 10 of the quadrangular barrel body 24' is located above the tilted catcher 33 on the line of tilt in the manner shown in FIGS. 6–8.

In order to avoid redundancies and explain individual operations of squeezing-sealing the top portion of the quadrangular barrel body 24', FIGS. 6–8 are in the form of divided figures, but the quadrangular barrel bodies 24' represented with a two dots-and-dash line appearing in the figures are the same one, and devices appearing in the figures constitute one set.

For convenience of illustration, the catcher 33 is represented with a fine two dots-and-dash line in the figures.

In the squeezing-sealing device 36 for squeezing-sealing the quadrangular barrel body 24', a pair of front forming plates 44' in FIG. 6 and a pair of rear forming plates 44" in FIG. 7 are screwed on ball screws 42', 42" pivoted between rocking links 40' and 40' on ends thereof and between rocking links 40" and 40" on ends thereof, respectively, which rocking links 40', 40' and 40", 40" are supported on a pair of supports 37', 37' and a pair of supports 37", 37", respectively; the pair of front forming plates 44' and the pair of rear forming plates 44" move maintaining a predetermined relational angle with the rocking links 40', 40' and maintain a relative position with respect to push-in plates 46, 46, and individual parts of the squeezing-sealing device 36 are individually controlled to perform predetermined operations.

The quadrangular barrel body 24' held in the catcher 33 which has moved horizontally to a predetermined position and has been tilted at a predetermined angle as described above rises alone the angle of the tilt toward the squeezing-sealing device 36 until the borderline between the front plane 12 and the top plane 10 agrees with the tip of the front forming plates 44', 44', and stops.

The front and rear forming plates 44', 44' and 44", 44" are pivotally supported in a relatively, laterally movable manner through controlled revolutions of the ball screws 42', 42' which are reversely threaded with respect to the center thereof; electromagnetic clutches 43', 43" linked with a rotating drive (not shown) are disposed at one end of the ball screws.

Base portions of the pair of strip-like front forming plates 44', 44' intended for the top plane 10 of the quadrangular barrel body 24 are screwed on the ball screw 42' at reverse screws 41, 41' thereof in a relatively, retractably movable manner, and lateral notches 45', 45' are cut in the front forming plates 44', 44' on the base portion side thereof.

Base portions of the pair of rear forming plates 44", 44" are screwed on the other ball screw 42" at reverse screws 41, 41' thereof as in the case of the aforesaid front forming plates 44', 44', which rear forming plates 44", 44" are <-shaped when viewed from above and are shorter by a set length and have lateral notches 45", 45" cut on the base portion side thereof.

Figure 14:
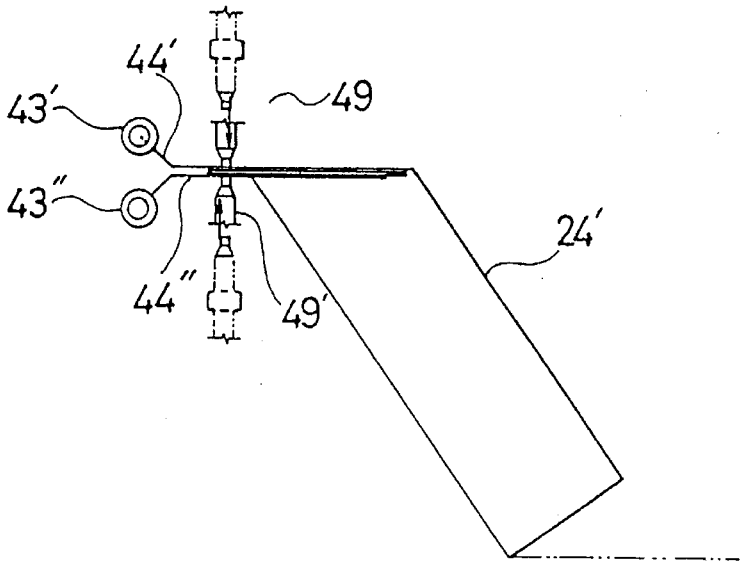
FIG. 14 is a schematic side view illustrating spot heat sealing to the upper opening portion of a packing bag.

The front and rear forming plates 44', 44' and 44", 44" are appropriately thin to have flexibility and yet have a sufficient rigidity, and are such that their peripheries do not damage the film sheet 14; the forming plates 44', 44' and 44", 44" are opposed to each other and are relatively able to surface-to-surface abut with and move away from each other in a stationary posture through respective turning devices 39', 39" and arms 40', 40' and 40", 40" as shown in FIGS. 12–14; in the stationary state of FIG. 12, the front and rear forming plates 44', 44' and 44", 44" are in a parallel posture maintaining a predetermined distance therebetween; in the abutting state of FIG. 14, the front and rear forming plates 44', 44' and 44", 44" are able to abut with each other trough rigidity of their material.

The squeezing-sealing device enters an operation of forming the top plane 10 of the quadrangular barrel body 24' in FIG. 13 to the onesidedly slant shape; with ends of the front forming plates 44', 44' located at the borderline between the front plane 12 and the top plane 10 being taken as fulcrums, the front forming plates 44', 44' transfer from a position represented with a solid line to a position represented with a two dots-and-dash line by making an angular arc movement indicated by arrow A, which transfer is caused by an operation of the reverse screws 41, 41' of the ball screw 42' which holds the front forming plates 44', 44' in an integral manner.

During the aforesaid transfer, the rear forming plates 44", 44" are maintained in the direction of width thereof, and the side planes of the quadrangular barrel body 24' between the front and rear forming plates 44', 44' and 44", 44" are apt to slacken due to the are movement associated with the operation of forming the top plane 10 of the front forming plates 44', 44'; in order to eliminate the slack positively, the substantially trapezoidal push-in plates 46, 46 having lateral notches 47, 47 cut therein are disposed in a retractably movable manner from both sides through rods 48 attached to air cylinders (not shown) or the like as shown in FIG. 8, which push-in plates 46, 46 are pushed inward from both sides to remove the slack which occurs.

At the time of the aforesaid operation, with the bottom of the sealed lapped edge portion 13' (the top position of the inside of the packing ball 1'") being taken as a fulcrum, the rear forming plates 44", 44" screwed on the ball screw 42" at reverse screws 41, 41' thereof make an angular arc movement indicated by arrow B from a position represented with a solid line to a position represented with a two dots-and-dash line in FIG. 13 synchronously with the operation of the push-in plates 46, 46; in FIG. 14, the push-in plates 46, 46 (not shown in the figure) get in by a removed slack between the front forming plates 44', 44' and the rear forming plates 44", 44", and hence the front forming plates 44', 44', the push-in plates 46, 46, and the rear forming plates are overlaid one on the other with the film sheet 14 of the formed top plane of the quadrangular barrel body 24' being clamped therebetween as required.

Upper and lower spot heat sealers 49, 49' which have been standing by in such a manner as not to interfere with the squeezing-sealing device 36 are disposed so as not to interfere with each other; the upper and lower spot heat sealers 49, 49' spot heat seal the lapped edge portion 13' of the quadrangular barrel body 24' through notches 45', 45', 45", 45", and 47, 47 being cut in the front forming plates 44', 44', rear forming plates 44", 44", and push-in plates 46, 46, respectively.

In FIGS. 6–8, vertical arrows of a dotted line indicate rising and lowering operations of the spot heat sealers 49, 49'.

Figure 17:
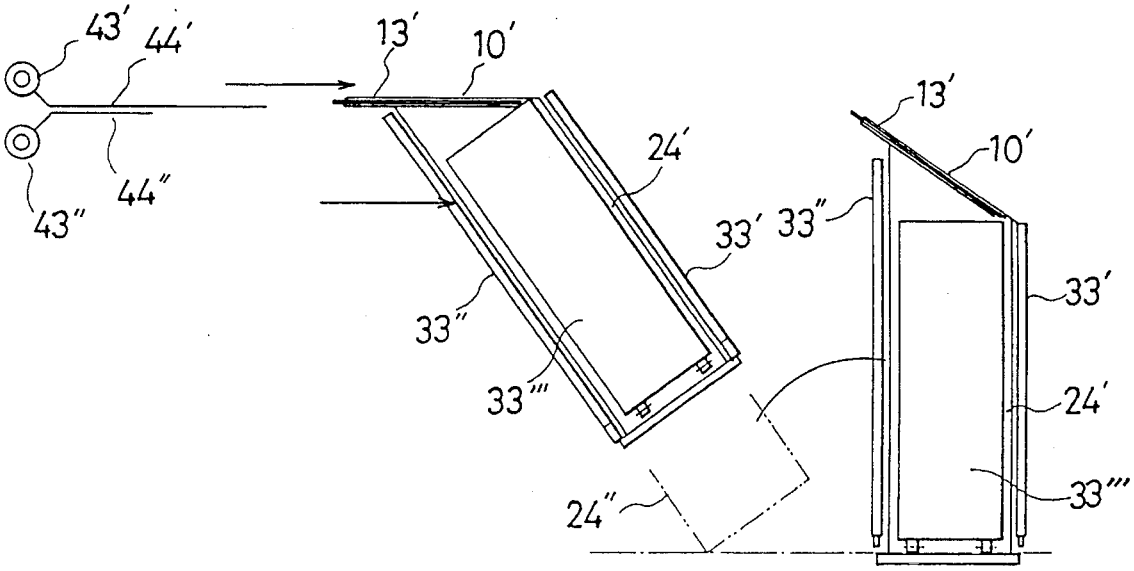
FIG. 17 is a schematic side view illustrating a process after ending spot heat sealing to the packing bag.

After the aforesaid operations have been completed, the quadrangular barrel body 24' which had its top lapped edge portion 13' spot heat sealed is held in the catcher 33, and in this state the electromagnetic clutches 43', 43" are operated to retract the front forming plates 44', 44" and the rear forming plates 44", 44" in such a manner as not to interfere with the spot sealed positions through the ball screws 42', 42"; at the same time, the push-in plates 46, 46 are returned to their original position, and as shown in FIG. 17, the catcher 33 is moved horizontally (to the right in the figure) to be released from the front forming plates 44', 44' and the rear forming plates 44", 44", lowered to the level of the initial horizontal movement after a sufficient release has been made, and then returned to an upright posture from the previous slant posture.

Figure 18:
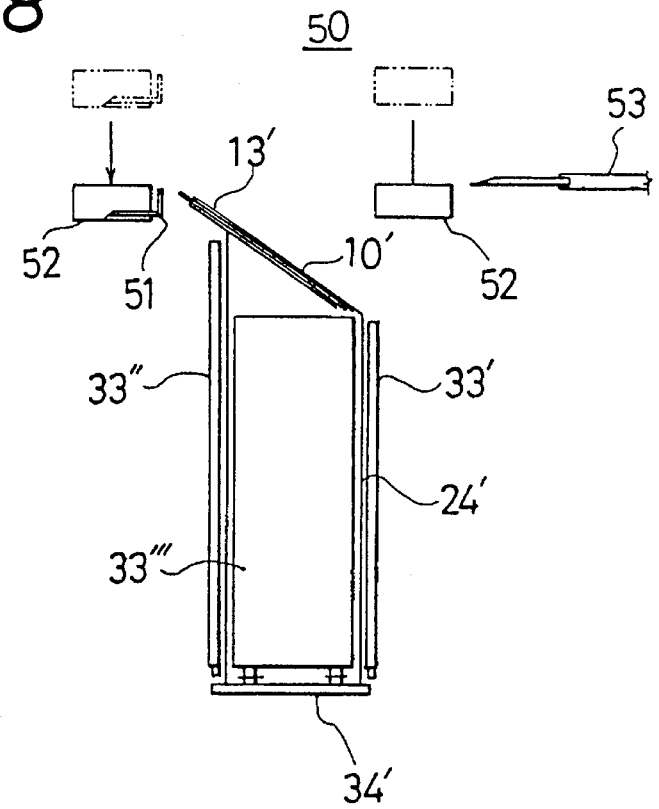
FIG. 18 is a side view illustrating a trimming process.

As shown in FIG. 18, where the catcher 33 is positioned so as not to interfere with the upper and lower spot heat sealers 49, 49', a trimming device 50 is disposed; the lapped edge portion 13' of the quadrangular barrel body 24' in an upright posture is linear along the top plane 10, but is bent backward (to the left in the figure) with respect to the rear panel 11, and part of the film sheet 14 is projecting from the lapped edge portion 13'.

Figure 19:
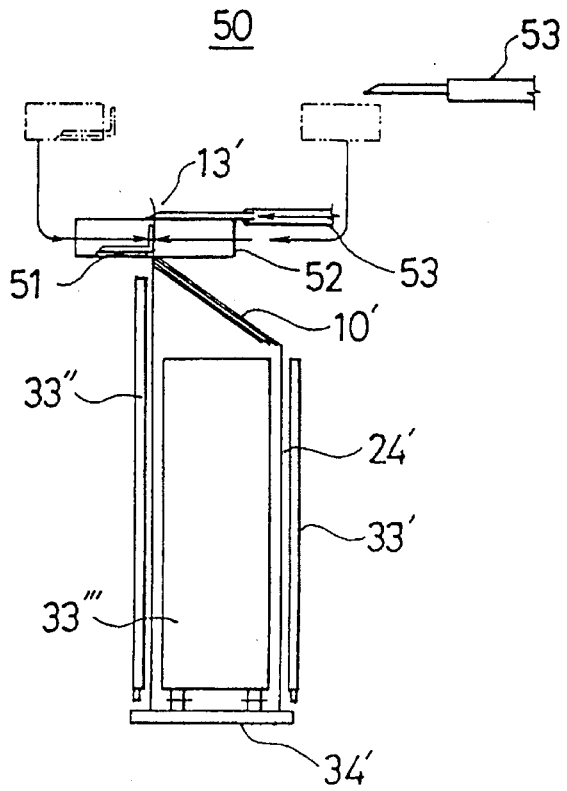
FIG. 19 is a schematic side view illustrating the end of the trimming process.

In the trimming device 50, lateral heat sealers 52, 52 are disposed in an opposed manner above the quadrangular barrel boy 24' for the final sealing of the top lapped edge portion 13'; moreover, the heat sealer 52 behind the lapped edge portion 13 (on the left-hand side in the figure) is equipped with a correction finger 51, and the other heat sealer 52 is accompanied by a cutter 53 in a retractably movable manner, which cutter slides on the top surface of the heat sealer 52 for cutting as shown in FIG. 18; when the quadrangular barrel body 24' becomes upright after following the aforesaid operations, the lateral heat sealers 52, 52 which have been located in the stand-by position represented with a two dots-and-dash line lower together with the correction finger 51 and the cutter 53 to the position represented with a solid line in FIG. 19; in this operation, the correction finger 51, first, rights the slanted lapped edge portion 13 to align it with the rear plane 11; then, the both lateral heat sealers 52, 52 press the lapped edge portion 13 from both sides for heat sealing, and at the same time, the cutter 53 is operated to cut off the projecting film sheet 14; then, the devices return to the positions represented with a two dots-and-dash line.

As shown in FIG. 1, a belt conveyor 54 is disposed laterally at the bottom portion of the manufacturing apparatus 12, which belt conveyor 54 serves as a device for transfer to a casing apparatus or the like at the next stage; a guide chute 55 extends downward and opens onto the belt conveyor 54 on the base side thereof, which guide chute 55 has a <-shaped cross section and is made of metal or synthetic resin; an air cylinder type stopper 56 is located near the lower portion of the guide chute 55, and an air cylinder type pusher 57 as an inverting device is located slightly above the stopper 56, the stopper 56 and the pusher 57 advancing and retracting through the back panel of the guide chute 55; when the guide chute 55 receives the packing bag 1''' with its top plane 10' and lapped edge portion 13' being squeezed and sealed dropping upright from the catcher 33, if the stopper 56 is in the retracted state, the packing bag 1''' is transferred on the belt conveyor 54 to the next stage in the regular posture (a) (trapezoid when viewed from side) as indicated by the arrow of a solid line in FIG. 1; if the stopper 56 is projected and after a slight time lag the pusher 57 is projected, the packing bag 1''' is transferred on the belt conveyor 54 in the inverse posture (b) (inverse trapezoid when viewed from side) as indicated by the arrow of a dotted line in FIG. 1; as symbolically illustrated above the end of the belt conveyor 54, the backing bags 1''', 1''' are packed in a case 8 of corrugated fiberboard or the like at the next stage in such a posture that they abut with each other at their top planes 10 in a longitudinally complementary manner, and hence as described before, the packing bags 1''', 1''' . . . can be tightly packed in the case 8 with nearly no dead space formed therein.

Incidentally, as shown in FIG. 2, individual operating mechanisms of the aforesaid apparatus 12 for manufacturing packing bags are electrically connected to an appropriate control device 100 with a built-in computer, and controlled according to predetermined programs and sequences through register marks.

The reference numeral 58 denotes predetermined block, powder and liquid merchandise to be filled in such as snack confectionery, seasonings, juice and the like; a predetermined amount of the merchandise is supplied from a predetermined weighing device (not shown) at the preceding stage into the quadrangular barrel body 24' through a hopper and the former 20 when the outer cylinder 21''' of the dual cylinder 21 lowers and forms the flat bottom 5' of the quadrangular barrel 24' in cooperation with the bottom receiver plate 28.

At this time, the inner cylinder 21' of the dual cylinder 21 is allowed to rise/lower by a predetermined stroke with respect to the outer cylinder 21''' through a lifting device 23'.

A process of manufacturing the packing bag 1''' from the film sheet 14 (made of a material not causing a qualitative change to the merchandise 58) and filling the packing bag 1''' with the merchandise 58 automatically will now be described with reference to FIGS. 1–19.

The predetermined paper or film sheet (including laminated sheet) 14 made of a synthetic resin coming from the bobbin 13 passes the dancer roll 15 and is fed at a predetermined pitch by the fixed-dimension feed roll 18 pressed against the presser roll 17 and by the fixed-dimension feed belt 25; the film sheet 14 passes the device 16 which detects register marks previously printed thereon, and register mark signals are sent to the control device 100 to perform predetermined control operations; the film sheet 14 is heated as appropriate according to a material thereof, and the stampers 19, 19', the lower portion being the fixed side and the upper portion being the feed side, lower instantaneously at a stop of regular feed to stamp ruled lines for making inward and outward fold marks (not shown) by pressing; then, as in the conventional form, the sheet 14 is formed to the cylinder 24 along the cylindrical portion 21' of the cylinder 21 and red down by the fixed-dimension feed belt 25; both longitudinal edge portions are heat sealed by the longitudinal sealer 26: the cylindrical film sheet is then formed to the quadrangular barrel body 24' having a quadrangular cross section by the outer cylinder 21''' following the cylindrical portion 21' of the cylinder 21; the quadrangular barrel body 24' is fed one pitch by one pitch by the synchronous operation of the film fixed-dimension feed belt 25 and the fixed-dimension feed roll 18 under the control of the control device 100 through control signals derived from printed register marks; the quadrangular barrel body 24' stops where it extends downward by a predetermined stroke from the bottom portion of the inner quadrangular cylinder 21, and the folding bars 31' and gusset tuckers 32, 32' of the cornering device 30 advance as required to form a gusset fold portion; then, the lateral heat sealer 27 operates to clamp the quadrangular barrel body 24', and the built-in cutter (not shown) of the lateral heat sealer 27 cuts the quadrangular barrel body 24' laterally; then, the lateral heat sealer 27, folding bar 31 and gusset tucker 32 return to their original positions, and during their return to their original positions, the bottom portion of the quadrangular barrel body 24' is cooled by cold air blow; then, the gusset tucker 32 advances laterally to give a fold mark for facilitating the formation of the quadrangular bottom 5; the lower inner cylinder 21'' of the cylinder 21 lowers by a predetermined stroke through a link 23' of the lifting device, and at the same time the bottom receiver plate 28 advances laterally at a predetermined timing, thereby finish cornering the flat bottom and flattening the lateral bottom heat seal in cooperation with the inner cylinder 21''; during that time, the merchandise 58 having been weighed as required at the preceding stage is supplied through the top portion of the former 20 under the control of the control device 100.

In this connection, by installing a completion-of-filling sensor in the inner cylinder 21' as appropriate, the quantity of the filled merchandise 58 can be detected as an input to the control device 100.

In forming the quadrangular barrel body 24' by the quadrangular barrel shaped cylinder 21''' in the manufacturing process, devices having such parts that can endure a certain degree of press against corner portions applied from outside when forming the bottom plane to a flat plane and when forming the top plane to a onesidedly slant shape are disposed, and hence a device may be mounted as needed that presses or slides a hot plate or a cornering roller against corner portions depending on the corner portions to be pressed within a tolerance in order to finish the corners sufficiently for obtaining a better shape before filling with the merchandise.

When the bottom receiver plate 28 retracts, the quadrangular barrel body 24' filled with the merchandise 58 is gently delivered or dropped, depending on the contained merchandise, into the catcher 33 which is open under the lateral heat sealer 27, and the quadrangular barrel body 24' is supported on the receiver plate 34' which serves as a stopper and which is integrated with the catcher 33 and can be opened downward by means of an air cylinder The state described above is shown in FIGS. 10 and 11.

As shown in FIG. 12, the catcher 33, wherein the receiver plate 34' as a stopper blocks the bottom thereof to support the quadrangular barrel body 24', advances to a predetermined position where it does not interfere with the next operation of bag making and packing; then, the catcher 33 is tilted by the tilting/righting electromagnetic device 35; the catcher 33 is brought close to the squeezing-sealing device 36, which has been standing by with respect to the tilted catcher 33, i.e. the quadrangular barrel body 24', by a lifting/moving device (not shown) using an air cylinder or servomotor; during this time, the catcher 33 is vibrated as required in order to put the merchandise 58 in a stable state and to reduce the volume of the merchandise 58.

Then, in the squeezing-sealing device 36, the distance between the opposed ends of the front forming plates 44' and the rear forming plates 44" is slightly narrowed as shown in FIG. 12, and also the distance between a pair of the front forming plates and the distance between a pair of the rear forming plates are set slightly narrower in advance than the side-to-side width of the packing bag 24' by means of the ball screws 42', 42", thereby making their insertion easier; as a result, the front forming plates 44' and the rear forming plates 44' are smoothly inserted into a top opening portion 10' down to a predetermined design position.

Then, since the front and rear forming plates 44' and 44" are reversely threaded with respect to the center thereof in advance, their regular/reverse revolutions cause the end portion width and the end portion distance both narrowed with respect to the quadrangular barrel body 24' to agree with the size of the top opening portion 10' through the ball screws 42', 42" and the reverse screws 41, 41' thereof; as a result, existing rumples and slack disappear.

When the forming plates 44', 44" are inserted into the opening portion 10' of the quadrangular barrel body 24' by a designed amount, under control of the control device 100 and as shown in FIG. 13, the front film sheet makes a backward arc movement with ends of the front forming plates 44' being taken as fulcrums as indicated by A from the position represented with a solid line to the position represented with a two dots-and-dash line, and at the same time, as shown in FIG. 8, the push-in plates 46, 46 having been standing by on both sides advance inward to fold the film sheet; consequently, at the top opening portion 10', front and rear edges and right and left edges are folded in an overlaid manner; then, as a result of the continuous inward advancement of the push-in plates 46, the film sheets of the top opening portion 10' are overlaid to integrate on the rear-side rear forming plates 44" which operate so as to become parallel with the front forming plates 44' at a predetermined timing, speed and position.

Then, the spot seat healers 49,49' which have been standing by above and under the forming plates 44', 44" move vertically from the position represented with a two dots-and-dash line to the position represented with a solid line as shown in FIG. 14, and execute tentative spot heat sealing through the notches 45', 45" in the forming plates 44', 44" and the notches in the push-in plates 46.

In the embodiment, the tentative heat sealing is executed at three points as illustrated; however, since the tentative heat sealing is intended to maintain the shape, the number of spots may be determined as appropriate on condition that there arises no interference with the withdrawal of the both forming plates 44', 44".

Figure 15:
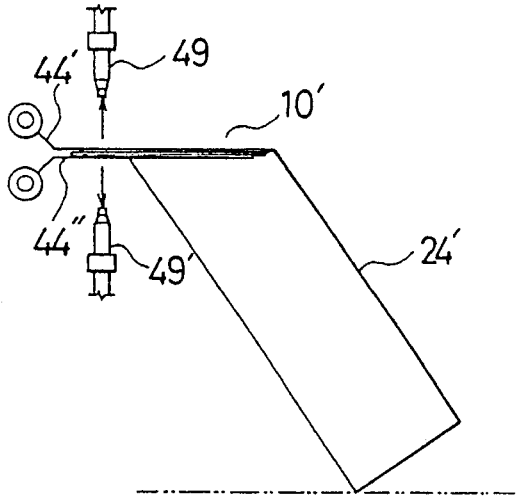
FIG. 15 is a schematic side view illustrating a process of ending spot heat sealing to the packing bag.
Figure 16:
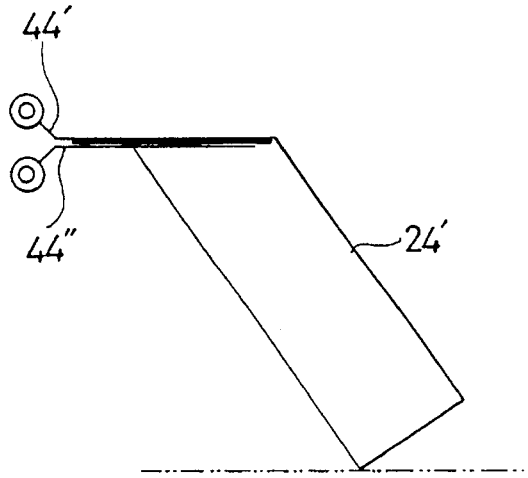
FIG. 16 is a schematic side view illustrating squeezing and sealing.

Then, the spot heat sealers 49, 49' are vertically retracted as shown in FIG. 15, and the top opening portion 10' of the quadrangular barrel body 24' (squeezed and sealed to a form of near packing bag 1''' in this state) is in the tentatively sealed state; then, the forming plates 44', 44" are gradually brought closer to each other by means of the reverse screws 41, 41' rotated in reverse by the rotating drive (not shown) through the electromagnetic clutches 43', 43" until the distance therebetween reaches the position of no interference with the spot heat sealed portion; then, the quadrangular barrel body 24', together with the catcher 33, is moved to the right over a predetermined distance as illustrated, and thus the forming plates 44', 44" are withdrawn from the top opening portion 10' of the quadrangular barrel body 24' as shown in FIG. 17.

Since the top opening portion 10' of the quadrangular barrel body 24' and the forming plates 44', 44" are mutually in the horizontal state, the forming plates 44', 44" are smoothly withdrawn without hindrance.

During this operation, the side angular push-in plates 46 are also retracted sideways.

Needless to say, in this case, it is also possible to execute relatively the aforesaid withdrawal by returning the catcher 33 to the upright posture through the tilting/righting electromagnetic device 35 as shown in FIG. 17.

As described above, the quadrangular barrel body 24' having the lapped edge portion 13' formed by spot heat sealing the top opening portion 10' thereof longitudinally is returned to the original upright posture in the state held in the catcher 33; then, as shown in FIG. 18, the lateral heat sealer 52 of the trimming device 50 standing by at an upper level shown at the left of the figure and the correction finger incorporated thereinto as a set lower together behind the lapped edge portion 13', while the heat sealer 52 and the cutter 53 attached thereto also lower ahead of the lapped edge portion 13', the heat sealers 52 approaching each other; as shown in FIG. 19, the correction finger 51 rights the slant upper laterally sealed portion, and then the lateral heat sealers 52. 52 join to finish seal and trim the lapped edge portion 13'.

Thus, the packing bag 1''' containing the merchandise 58 is squeezed and sealed at the top plane 10 thereof, and when the bottom receiver plate 34' of the catcher 33 is opened by the air cylinder 34 through the controller 100, the packing bag 1''' as a final product thus formed is transferred to and drops in the guide chute 55 by the own weight thereof; in the state that the stopper 56 at the lower portion of the guide chute 55 is retracted, a projection of the pusher 57 causes the packing bag 1''' to be ejected from the guide chute 55 onto the belt conveyor 54 serving as a transferring apparatus in the regular posture (a) as indicated with an arrow of a solid line in FIG. 1; when the stopper 56 projects for a set time to receive the quadrangular barrel body 24', i.e. the packing bag 1''' once under control of the controller 100 and when the pusher 57 located thereabove then projects to invert the packing bag 1''' using the stopper 56 as a fulcrum, the packing bag 1''' is ejected from the guide chute 55 in the inverse posture as indicated with an arrow of a dotted line; accordingly, by conveying the pacing bags 1''' on the belt conveyor 54 in the alternating regular (a) and inverse (b) postures as in the form of FIG. 1, the packing bags 1''', 1''' are accumulated in the mutually complementary regular (a)

and inverse (b) postures as illustrated above the leading end of the belt conveyor 54 in a virtual manner, and hence packing in a case of corrugated fiberboard or the like at a quite high filling rate without aforementioned dead space is possible at the next stage (not shown); accordingly, effective transport can be made in a transport process, transport costs can be reduced, and not only the rattling of packing bags in a case but a damage to merchandise or the like does not arise.

Figure 20:
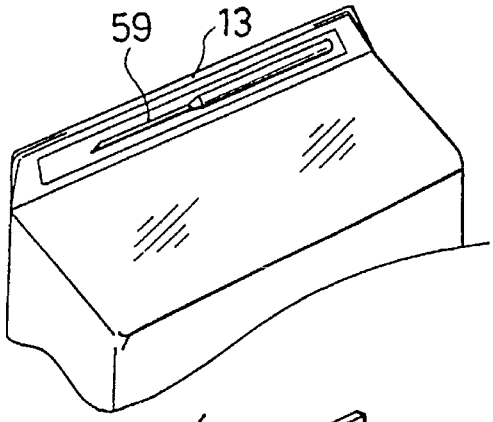
FIG. 20 is a partially enlarged perspective view illustrating another form of a packing bag.
Figure 21:
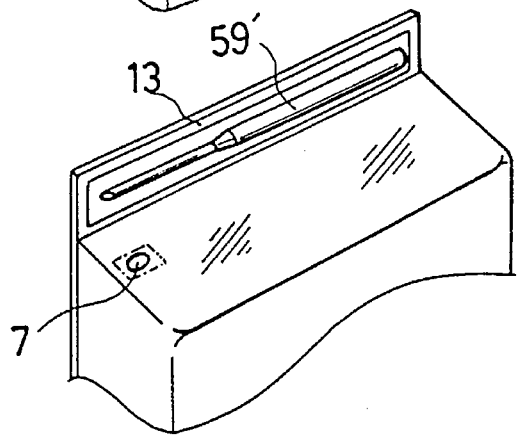
FIG. 21 is a partially enlarged perspective view illustrating a further form of a packing bag.
Figure 22:
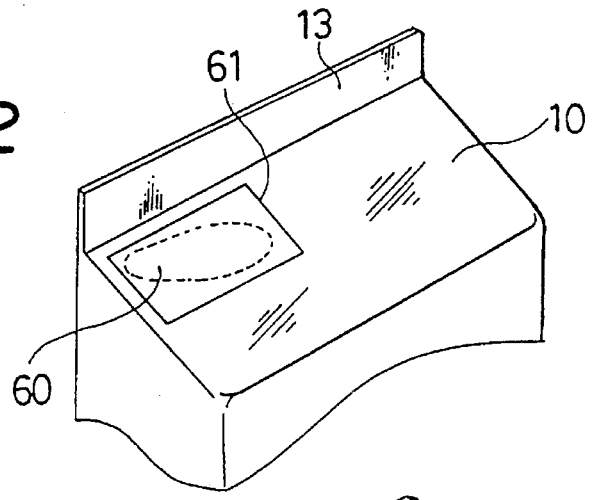
FIG. 22 is a partially enlarged perspective view illustrating still another form of a packing bag.
Figure 23:
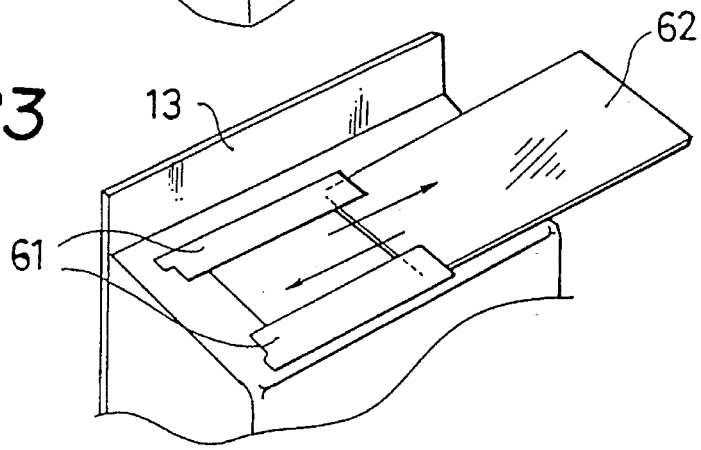
FIG. 23 is a partially enlarged perspective view illustrating a still further form of a packing bag.

As for the packing bag 1''' manufactured according to the applied invention, in addition to the aforementioned form, feasible forms include the following: as in an embodiment shown in FIG. 20, a strip fastener 59 is provided at the lapped edge portion 13 in order to allow the user to open/close a packing bag itself as desired; as in an embodiment shown in FIG. 21, a straw 59' is provided at the lapped edge portion 13; moreover, a large hole 60 is provided in the top plane 10, and a seal 61 is attached thereto and removed as appropriate for opening; and furthermore, as shown in FIG. 23, a tougher packing material is used, and the large hole 60 is formed in the top plane 10 with slide guides 61, 61 being provided on both sides thereof, thereby allowing a slide cover 62 to be opened/closed as desired: and it is possible for a manufacturing process to employ various forms including: a belt conveyor is replaced with a robot hand equipped with a vacuum chuck head in order to perform a packing process simultaneously by utilizing vacuum, and because of easy accumulation, the packing bags 1''' are accumulated to a predetermined quantity and a predetermined size and packed in a flat blank case, so-called wraparound packing; and when a top plane is squeezed and sealed, nitrogen gas, carbon dioxide gas or the like is filled into a packing bag or replaces the air contained therein, or a deaerating process is performed.

As for materials to be used, either adhesive single coated type or adhesive double coated type is usable unless they cause a change of quality or the like to merchandise such as foods or the like to be contained, and it is also possible to increase strength and shape maintaining property by using so-called tougher materials; the present embodiment has been described by taking up packing by a packing machine based on a longitudinal pillow, which packing takes time for forming and sealing a top plane portion as compared with time required for forming a quadrangular barrel and quadrangular bottom from film sheet through the filling of merchandise, and hence efficiency may be improved by manufacturing a plurality of sets of top plane portion forming-sealing units; moreover, as a method of increasing a speed, a packing machine having a mandrel type mechanism may be used in an applied manner, in which application, a quadrangular portion is formed in the upright state by a mandrel portion, and at the same time a top plane portion is given a fold mark, and then the quadrangular body is fed forward and filled with merchandise, and then the top plane portion is formed and sealed by the method described in the description of the embodiment, or since the top plane portion is already given a fold mark, it is possible to form the top plane portion and seal a lapped edge portion while holding essential portions of the quadrangular body from outside by vacuum; needless to say, it is also possible to implement a plant by equipping the conventional mechanisms with attachments as needed and as appropriate.

Also, in manufacturing bags, in place of the aforementioned sequence of the embodiment, a process may be such that the forming and squeezing-sealing of a top plane are executed, and then the filling of merchandise is executed, and then a bottom plane is formed.

As stated before, applicable merchandise includes block merchandise such as snack confectionery or the like, powder merchandise such as seasonings, detergent or the like and juice, milk and the like; as for packing bags with a spout containing liquor or the like, by attaching spouts opposingly on top planes to avoid their interference at alternate combination, the volume of containers of delivery can be reduced, and hence the present invention is sufficiently applicable to such packing bags with a spout.

What is claimed is:

1. A method for manufacturing a quadrangular package bag comprising:

feeding a film-like sheet from a bobbin;

feeding said sheet through a former and along a cylinder;

longitudinally sealing said sheet to form a tube;

laterally cutting said tube;

laterally sealing said tube to form a lateral seal;

flattening the lateral seal to form a bag bottom of a quadrangular barrel, the quadrangular barrel having a front side and a back side;

filling the barrel with merchandise;

separating the barrel from the tube; and closing the top of the filled barrel by forming a package bag slanted planar top, the planar top slanting between an upper edge line of the front side and an upper edge line of back side and sealing the top.

2. The method according to claim 1, wherein said steps of forming and sealing include a process of adjusting the tilted posture of said quadrangular barrel.

3. The method according to claim 1 wherein a pressure plate or pressure roller is attached for reinforcing a cornering of ridges at each corner of the quadrangular barrel formed to a bag.

4. The method according to claim 1, wherein the inside of the quadrangular barrel is deaerated at the time of sealing the top.

5. The method according to claim 1, wherein a posture of transfer of the package bags is regulated between a regular posture and an inverse posture in a process of transfer to a casing station.

6. The method according to claim 1, wherein said forming includes using a packing machine of a mandrel system and wherein after the step of forming a bottom plane or the slanted planar top, the step of filling and then the step of sealing are executed in a sequential manner.

7. The method according to claim 6, wherein the step of sealing is executed with the quadrangular barrel being in an upright posture.

8. The method according to claim 1, wherein in said step of forming, a quadrangular bottom is formed, followed by the filling of merchandise, and then the slanted planar top is formed.

9. An apparatus for manufacturing a quadrangular package bag comprising:

means for feeding a film-like sheet from a bobbin;

feeding means for feeding said sheet through a former and along a cylinder;

longitudinal sealing means for longitudinally sealing said sheet to form a tube;

cutting means for laterally cutting said tube;

lateral sealing means for laterally sealing said tube to form a lateral seal;

flattening means for flattening the lateral seal to form a bag bottom of a quadrangular barrel, the quadrangular barrel having a front side and a back side;

filling means for filling the barrel with merchandise;

separating means for separating the barrel from the tube;

squeezing-sealing means for closing the top of the filled barrel by forming a package bag slanted planar top, the planar top intersecting an upper edge line of the front side and an upper edge line of back side, and by sealing the top.

10. The apparatus according to claim 9, wherein said squeezing-sealing means includes forming plates for the slanted planar top of the quadrangular barrel and push-in plates for side portions thereof.

11. The apparatus according to claim 10, wherein said squeezing-sealing means includes a pot heat sealer for a lapped edge portion of the slanted planar top.

12. The apparatus according to claim 9, including a trimming device for a lapped edge portion of said top slanted planar.

13. The apparatus according to claim 9, including a guide chute having a posture controller for putting the package bag in a regular or an inverse posture.

14. The apparatus according to claim 9, wherein said squeezing-sealing means includes a sensor for merchandise in the quadrangular barrel.

* * * * *